United States Patent [19]

Osterberg

[11] 4,451,359

[45] May 29, 1984

[54] HYDRAULIC FLOW DISTRIBUTOR IN GOLD SEPARATOR AND METHOD

[76] Inventor: Daniel Osterberg, 5728 Tarpey Dr., Fresno, Calif. 93727

[21] Appl. No.: 363,533

[22] Filed: Mar. 30, 1982

[51] Int. Cl.[3] ..... B03D 5/68

[52] U.S. Cl. ..... 209/158; 209/454; 209/500; 138/41; 239/DIG. 18

[58] Field of Search ..... 209/158, 159, 423, 424, 209/454, 474, 486, 500; 55/99, 474; 210/289, 291; 138/41; 239/DIG. 18

[56] References Cited

U.S. PATENT DOCUMENTS

| | | | |
|---|---|---|---|
| 899,710 | 9/1908 | Boardman | 209/18 |
| 1,291,137 | 1/1919 | Reed | 209/474 |
| 1,452,815 | 4/1923 | Reed | 209/454 |
| 2,101,295 | 12/1937 | Rusk | 209/474 |
| 2,410,637 | 11/1946 | Darby | 209/486 |
| 2,708,517 | 5/1955 | Evans | 209/158 |
| 2,803,347 | 8/1957 | Whitlock, Jr. | 138/41 |
| 3,506,119 | 4/1970 | Rumpf et al. | 209/159 |
| 4,119,276 | 10/1978 | Nelson | 239/590.3 |
| 4,344,459 | 8/1982 | Nelson | 138/41 |

*Primary Examiner*—David L. Lacey
*Attorney, Agent, or Firm*—Allen A. Dicke, Jr.

[57] ABSTRACT

Gold flakes and small nuggets are separated from heavy sand by fluidizing the mixture with an upwardly flowing water column having a very uniform velocity across its section. The upwardly flowing water column has sufficient flow to fluidize the suspended material but not enough to carry the heavy sand over the top of the column. Heavy sand is withdrawn from the upper portion of the fluidized mixture to leave the gold below the withdrawal point.

5 Claims, 3 Drawing Figures

HYDRAULIC FLOW DISTRIBUTOR IN GOLD SEPARATOR AND METHOD

BACKGROUND

This invention is directed to a separator for separating gold in flake and small nugget form from heavy sand by fluidized bed techniques whereby the gold is gravitationally separated to the bottom of the column.

Most of the sand which may carry gold therein has been passed through a device for the separation of gold therefrom. These separators have usually been in the form of sluice boxes and the like which have separated from the lighter sand the larger gold nuggets. Smaller bits of gold, particularly flakes thereof, have not been separated and have been returned to the earth with the sand. Stream beds and banks are now being reworked by small suction dredges which have a sluice box or other separator output. These separate the heavy material from the light material and return the light sand to the stream. The heavy sand conserved by the separator has a density of about twice that of the ordinary silica sand. This heavy sand may contain gold flakes and other small gold particles so that another separation is necessary. Conventionally, the separation of the heavy sand away from the gold is by panning. In such panning, great care is used if little gold is wasted. Such careful panning is necessarily time-consuming so that the final separation from the portion conserved by the separator is tedious. A reliable and quick method and apparatus for separating the heavy fraction provided by the sluice box is required.

SUMMARY

In order to aid in the understanding of this invention, it can be stated in essentially summary form that it is directed to a gold separator having an upright riser which has a flow distributor in the bottom structure thereof. The bottom structure supports the upright riser, closes the flow distributor and provides for the inlet of water thereto so that water flowing up in the riser is of uniform velocity across the riser to uniformly fluidize the bed of heavy sand and gold so that gold flakes settle out and heavy sand can be removed. The uniformity of upward flow in the riser permits gravity separation in the fluidized bed without the turbulence which would prevent precise separation.

Accordingly, it is an object of this invention to provide a gold separator which quickly, easily and accurately separates gold from heavy materials in a non-turbulent fluidized bed. It is a further object to provide a gold separator which is economic of construction and simple of operation in order to provide a gold separator which can be used for the final separation of concentrates received from dredging and sluice box operation.

It is a further object and advantage of this invention to provide a hydraulic flow distributor which provides substantially non-turbulent water upflow through a separation zone to fluidize a bed of heavy concentrates including gold to aid in separation thereof, the flow distributor comprising a perforated plate covered with a plurality of layers of screen in the upward direction of water flow to minimize differences in velocity in the upwardly flowing water.

Other objects and advantages of this invention will become apparent from the study of the following portion of this specification, the claims and the attached drawings.

DESCRIPTION OF THE PREFERRED EMBODIMENT

Figures 1, 2, 3:
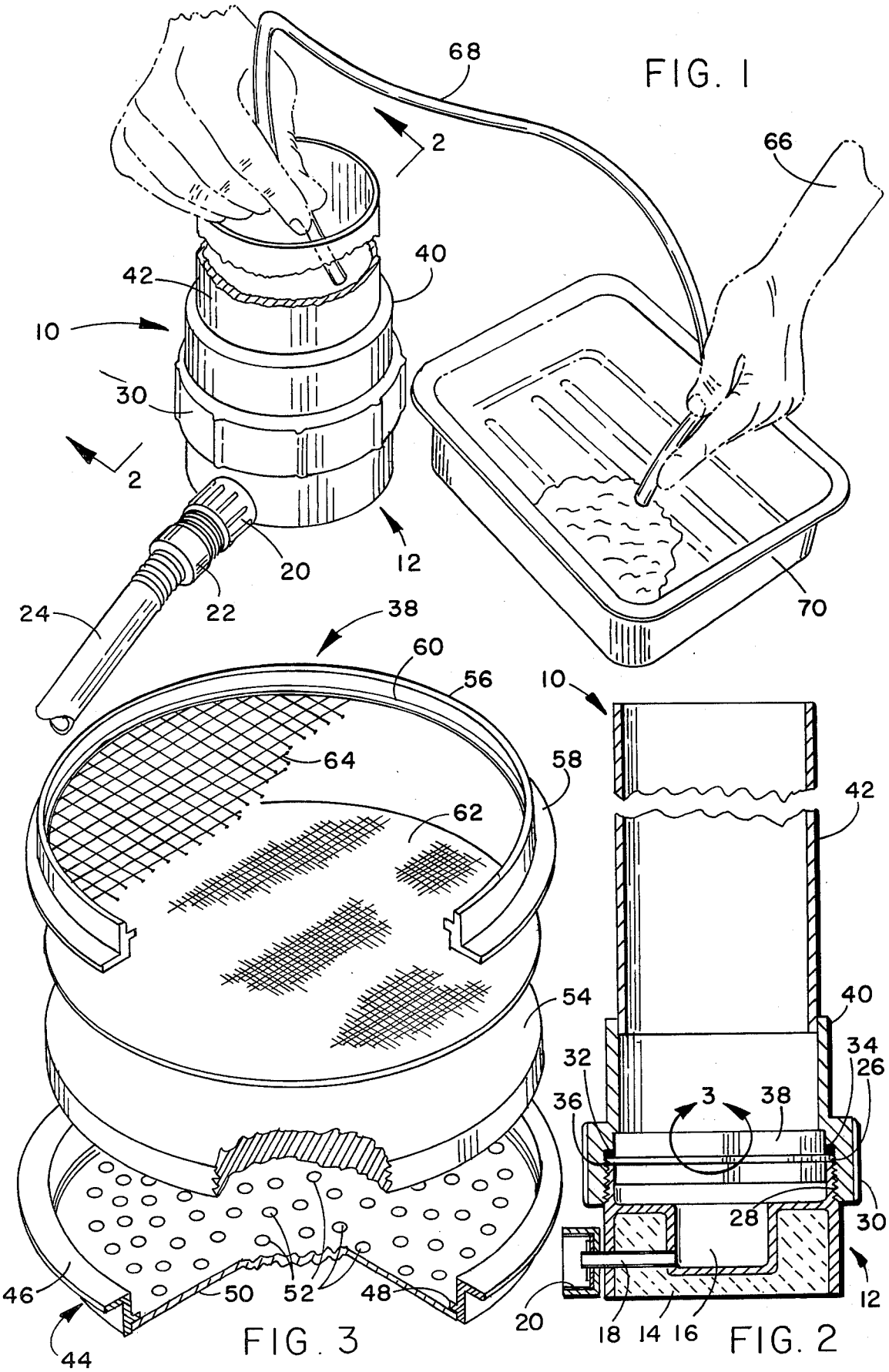
FIG. 1 is a perspective view of the gold separator of this invention illustrating its use.
FIG. 2 is a vertical section through the main body and riser of the gold separator of this invention.
FIG. 3 is an enlarged exploded view of the preferred embodiment of the flow distributor of this invention.

The preferred embodiment of the gold separator of this invention is generally indicated at 10 in FIGS. 1 and 2. Gold separator 10 has a base 12 which includes a flat bottom 14 on which the separator can stand. Inlet chamber 16 is formed in the base. Inlet nipple 18 extends from chamber 16 outward to carry an attachment device such as female hose coupling 20. The rate of flow of water into gold separator 10 is very critical and, thus, a flow controller 22 can be installed in the inlet line. Water under pressure is supplied by hose 24 from any conventional pressure water source. The source may be a drinking water supply or may be a water pressure connection on the gold dredge. Flow controller 22 can be in the form of an orifice, a manually controlled variable orifice, such as a cock valve, or can be an automatic flow control. For a 4-inch diameter gold separator, a flow rate of about 2 gallons per minute is suitable. Careful management o the flow rate is necessary for proper separation.

Base 12 extends upward to cylindrical shoulder 26. Shoulder 26 has threads 28 on the exterior thereof so that collar 30 can be threaded down thereon. Collar 30 has an interior shoulder 32 which engages against O-ring 34 so that flange 36 can be engaged, sealed and urged against shoulder 26. Flange 36 is on flow distributor 38, which is shown in detail in FIG. 3 and will be described hereafter. Tube 40 is formed integrally with collar 30 and extends upward therefrom and coaxial therewith. Riser 42 is removably pressed into the top of tube 40 to provide an upright column in which the dredge concentrates can be fluidized. Riser 42 is preferably transparent so that the fluidized bed can observed.

In order to provide an upwardly flowing water column in tube 40 and riser 42, flow distributor 38 must uniformly spread water flow laterally across the interior of tube 40. As is seen in FIG. 3, ring 44 is cylindrically tubular along the axis of flow distributor 38 and of the entire gold separator 10. At its upper end, it has outwardly extending flange 46 and adjacent its lower end, it has inwardly extending flange 48. Perforated plate 50 rests against flange 48 within the tubular body of ring 44 and serves as the first stage flow distributor. Perforated plate 50 has a plurality of perforations 52 therethrough which, on their lower side, are open to inlet chamber 16. Disc 54 fits within ring 44.

Disc 54 is a stack of felted, fibrous filter elements made of synthetic polymer composition material. Disc 54 thus serves as a flow equalizing material and permits the flow of water therethrough in the axially upward direction. Since the openings between the fibrous material are essentially connected together in the lateral direction, flow is very uniform through disc 54. The pressure drop is the same across the disc in the flow direction at any lateral position on the disc. Therefore, the flow through the disc is the same at any portion of the disc. Thus, disc 54 provides the necessary lateral uniformity of flow.

Ring 56 is the same as ring 44. It has an outwardly extending flange 58 which lies against flange 46 when the structure is assembled. Ring 56 has an inwardly extending flange 60 to retain the contents of flow distributor 38 therein. Mounted inside ring 56 and below flange 60 are fine screen 62 and coarse screen 64. Fine screen 62 has openings so fine that the upward flow of water therethrough is not substantially affected in its lateral uniformity. Similarly, coarse screen 64 has openings so large that the lateral uniformity of the upward flow is not substantially affected.

Flow distributor 38 is a permanently assembled structure. Rings 44 and 56 are preferably permanently secured together with the plate 50, disc 54, fine screen 62 and coarse screen 64 between them to form a flow distributor 38. When so assembled, the flanges 46 and 58 become the flange 36 which secures the flow distributor in place in the gold separator 10. Alternate structure to the felted fibrous material of disc 54 include multilayers of fine screen fabric, or other materials having lateral passages at right angles to the general water flow direction. In large structures, the flow equalizing (in the direction across water flow) material may be granular like sand.

FIG. 1 shows the preferred manner in which the gold separator 10 is used. When the gold separator is assembled, as shown in FIGS. 1 and 2, the gold separator is put in place and connected to the water supply. The proper flow is established, in the order of 2 gallons per minute with a 4-inch diameter separator. The concentrate from which the gold is to be separated is placed in tube 40 and riser 42 by dumping it in the top. The concentrate is heavy sand, such as magnatite carrying gold flakes. While gold has a density considerably higher than heavy sand, the larger surface area of the gold flakes per unit weight makes such flakes difficult to separate. However, in the gold separator 10, the non-turbulent upward flow of water through the heavy sand fluidizes the bed of sand concentrates to about twice its solid height in tube 40. The non-turbulent upward flow of water through the fluidized bed permits the gold flakes to separate out by gravitationally falling to the bottom. Since the upward water flow is non-turbulent, the gold flakes separate out without being remixed into the heavy sand by turbulent action in the fluidized bed or higher velocity of upward flowing jets rom water supply orifices in the bottom. Since the water flow is non-turbulent and the bed is fluidized to approximately twice its solid height, early in the separation it may be desirable to gently stir the fluidized mass of heavy concentrate to provide an opportunity for the gold flakes to settle.

Separation is accomplished in the preferred embodiment by siphoning off the upper portion of the fluidized bed. As shown in FIG. 1, operator 66 is using flexible siphon tube 68 to siphon off the water and upper portion of the fluidized bed into vessel 70. Vessel 70 permits the retention of the heavy sand so it may be reprocessed through further separation should it appear that gold flakes are not fully retained in separator 10. If a transparent siphon tube 68 is employed, the water and sand flowing into vessel 70 can be observed to determine the loss of any flake gold. Such loss might occur only when the lowest part of the heavy sand fluidized bed is siphoned off, close to the gold which settles out onto fine screen 62. The purpose of fine screen 62 is to prevent further downward motion of the gold, and coarse screen 64 serves to support screen 62 against the pressure of water flow.

While siphoning is a convenient and preferred method of removing the upper portion of the fluidized bed of heavy sand, the upper portion may be removed by other means such as scooping or opening side ports or interior standpipes positioned at various selected levels above the bottom.

It is important to note that the upward flow rate of water in the gold separator is insufficient to carry the lightest fraction over the top of riser 42. Only water flows over the top of riser 42, and the fluidized bed remains below the top thereof and the upper portion is removed by operator 66 employing siphon tube 68, or other removal means. When most of the first batch of heavy sand is removed, the operator may dump in another portion of concentrate for separation off of the major portion of the heavy sand, without first recovering the gold from the first batch. In other words, a number of batches of concentrate can be run while retaining the gold on screen 62.

When the task of gold separator 10 is complete, there may be some heavy sand still at the bottom of the fluidized bed. The gold and this last sand is washed into a gold pan, and the final separation can be manually accomplished.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A gold separator comprising:

an upright riser tube of uniform cross section defining an upright separation zone;

a flow distributor extending across the entire bottom of said tube, said flow distributor having a body comprised of upper and lower rings, said rings being secured together, a perforated plate supported by said lower ring, a coarse screen supported by said upper ring, a disc of fibrous material positioned adjacent said perforated plate and a fine screen positioned adjacent said coarse screen, said fine screen and said disc of fibrous material being dimensioned to fill the space between said perforated plate and said coarse screen, said flow distributor providing non-turbulent water upflow through said separation zone in said riser, with minimal transverse differences in water flow across said separation zone so that upflowing water can fluidize a bed of heavy concentrates to permit separation thereof;

a base, said base supporting said flow distributor and supporting said upright riser and a water connection on said base for supplying water for upflow through said flow distributor and upflow through said riser tube for providing non-turbulent water upflow to fluidize a bed of heavy concentrates in said separation zone to permit separation thereof.

2. The gold separator of claim 1 wherein inlet flow control means is connected to said base for controlling the rate of water flow into said base.

3. A method of separating gold from heavy sand concentrates with a gold separator having a non-turbulent water upflow in a riser comprising the steps of:

placing the gold flakes and heavy concentrate in the riser;

providing non-turbulent upward flow of water into the bottom of the riser by the steps of: controlling the flow rate of the water; sequentially passing the water through a perforated plate, a porous mass, a fine screen and a coarse screen and introducing the upflowing non-turbulent water into the riser in sufficient velocity to non-turbulently fluidize the bed of heavy concentrates and gold without carrying any portion of the bed over the top of the riser;

permitting the gold to settle in the fluidized bed; and removing the upper portion of the fluidized bed to increase the concentration of gold in the gold separator.

4. The method of separating gold of claim 3 wherein the upper portion of the fluidized bed is removed by siphoning.

5. A flow distributor for a gold separator which has a base with a water connection for supplying water to the lower side of the flow distributor and an upright riser tube of uniform cross-section for receiving upflowing non-turbulent water from the flow distributor for fluidizing a bed of heavy concentrates to permit separation thereof in the upright riser tube, said flow distributor comprising:

a circular bottom ring;

a perforated plate secured to said circular bottom ring;

a disc of felted, fibrous synthetic polymer composition material positioned on said perforated plate;

a fine screen disc positioned on said disc of fibrous material, said fine screen having openings sufficiently fine that upward flow of water therethrough is not substantially affected in its lateral uniformity;

a disc of coarse screen positioned on top of said disc of fine screen;

an upper circular ring, said disc of coarse screen being retained by said upper ring, said upper ring being secured to said lower ring to constrain said disc of fibrous material and said disc of fine screen between said perforated plate and said disc of coarse screen so that when water is supplied to the underside of said flow distributor, it provides non-turbulent water upflow therethrough.

* * * * *